US006889482B2

(12) United States Patent
Edwards et al.

(10) Patent No.: US 6,889,482 B2
(45) Date of Patent: May 10, 2005

(54) FILLER DEVICE SUB-ASSEMBLY

(75) Inventors: Simon P. Edwards, Irvine, CA (US); Michael R. Resterhouse, Muskegon, MI (US); Randall L. Johnson, Grand Haven, MI (US); Robert B. Szabo, II, Allegan, MI (US)

(73) Assignees: Fogg Filler Company, Holland, MI (US); Scholle Corporation, Irvine, CA (US)

( * ) Notice: Subject to any disclaimer, the term of this patent is extended or adjusted under 35 U.S.C. 154(b) by 0 days.

(21) Appl. No.: 10/268,546

(22) Filed: Oct. 10, 2002

(65) Prior Publication Data

US 2004/0068957 A1 Apr. 15, 2004

(51) Int. Cl.[7] ..... B65B 43/26
(52) U.S. Cl. ..... 53/384.1; 53/109
(58) Field of Search ..... 53/381.1, 381.4, 53/109, 281, 284.5, 468, 492; 141/168, 172, 165; 74/567, 569, 570

(56) References Cited

U.S. PATENT DOCUMENTS

| | | | | | |
|---|---|---|---|---|---|
| 3,430,639 | A | | 3/1969 | Roberts | |
| 3,568,734 | A | | 3/1971 | Vadas et al. | |
| 3,774,658 | A | | 11/1973 | Abramoska, Jr. | |
| 4,120,134 | A | * | 10/1978 | Scholle | 53/434 |
| 4,217,941 | A | | 8/1980 | Catalano | |
| 4,219,054 | A | | 8/1980 | Carter et al. | |
| 4,250,691 | A | * | 2/1981 | Marshall | 53/505 |
| 4,378,665 | A | | 4/1983 | Crankshaw et al. | |
| 4,437,498 | A | | 3/1984 | Pankratz et al. | |
| 4,458,734 | A | * | 7/1984 | Scholle et al. | 141/5 |
| 4,498,508 | A | | 2/1985 | Scholle et al. | |
| 4,510,737 | A | * | 4/1985 | Ellert | 53/570 |
| 4,530,433 | A | * | 7/1985 | Cucchetto | 198/803.7 |
| 4,535,585 | A | * | 8/1985 | Gardos | 53/247 |
| 4,721,138 | A | | 1/1988 | Simonazzi | |
| 4,765,119 | A | | 8/1988 | Aidlin et al. | |
| 4,815,256 | A | * | 3/1989 | Brown et al. | 53/468 |
| 4,848,381 | A | | 7/1989 | Livingston et al. | |
| 5,402,623 | A | | 4/1995 | Ahlers | |
| 5,402,833 | A | | 4/1995 | Clüsserath | |
| 5,450,882 | A | | 9/1995 | Cragun | |
| 5,531,253 | A | | 7/1996 | Nishiyama et al. | |
| 5,533,552 | A | | 7/1996 | Ahlers | |
| 5,690,151 | A | | 11/1997 | Rutter et al. | |
| 5,711,411 | A | | 1/1998 | Zurweller | |
| 5,740,844 | A | | 4/1998 | Miller | |
| 5,778,635 | A | | 7/1998 | Galandrino | |
| 5,844,677 | A | | 12/1998 | Dimmick, Sr. | |
| 5,845,683 | A | | 12/1998 | Sundby et al. | |
| 6,073,667 | A | | 6/2000 | Graffin | |
| 6,283,177 | B1 | * | 9/2001 | Naka et al. | 141/145 |
| 6,302,172 | B1 | | 10/2001 | De Villele | |
| 6,399,901 | B1 | | 6/2002 | Nishino et al. | |
| 6,655,109 | B2 | * | 12/2003 | Resterhouse et al. | 53/281 |

FOREIGN PATENT DOCUMENTS

| | | |
|---|---|---|
| EP | 0 554 951 A1 | 2/1993 |
| EP | 0 568 121 A1 | 2/1993 |

* cited by examiner

*Primary Examiner*—Eugene Kim
*Assistant Examiner*—Paul Durand
(74) *Attorney, Agent, or Firm*—King & Jovanovic, PLC

(57) ABSTRACT

A filler device sub-assembly having a manipulator for manipulating a cap of a container comprising a first and second cap gripper arm and a member for controllably manipulating the cap gripper arms. The controllable manipulating member comprising an inner cam assembly, an outer cam assembly and a follower. The outer cam assembly extends at least partially about the inner cam assembly. One of the inner and outer cam assemblies coupled to the first and second cap gripper arms. The follower is associated with the inner cam assembly and the outer cam assembly. Movement of the lifter shaft imparts movement of the follower and relative movement of the inner cam assembly and the outer cam assembly, to in turn, longitudinally and rotatably move the cap gripper arms from a first position proximate to a container to a second position distally spaced from a container.

20 Claims, 14 Drawing Sheets

FILLER DEVICE SUB-ASSEMBLY

CROSS-REFERENCE TO RELATED APPLICATION(S)

This application claims the benefit of U.S. Provisional Application Ser. No. 60/122,977 filed Mar. 5, 1999, and U.S. Provisional Application Ser. No. 60/122,539 filed Mar. 3, 1999, both of which are hereby incorporated herein by reference in their entirety. In addition, this application relates to U.S. patent application Ser. No. 09/871,562 filed May 31, 2001, U.S. Provisional Application Ser. No. 60/208,185 filed May 31, 2000 and PCT Patent Application Serial No. PCT/US01/17536 filed May 31, 2001, all of which are hereby incorporated herein by reference in their entirety.

BACKGROUND OF THE INVENTION

1. Field of the Invention

The present invention relates in general to a filler device sub-assembly, and more particularly, to a filler device sub-assembly, which among other things, substantially precludes air and/or other matter from undesirably entering an associated container upon and/or prior to filling of the same, which facilitates reliable uncapping, capping, and/or recapping of the container and which facilitates the cleaning of the uncapping and retaining structures.

2. Background Art

Filling assemblies for use in association with filler devices have been known in the art for years and are the subject of numerous patents including: U.S. Pat. No. 5,845,683; U.S. Pat. No. 5,740,844; U.S. Pat. No. 5,690,151; U.S. Pat. No. 5,533,552; U.S. Pat. No. 5,531,253; U.S. Pat. No. 5,450,882; U.S. Pat. No. 5,402,833; U.S. Pat. No. 4,848,381; U.S. Pat. No. 4,437,498; U.S. Pat. No. 4,219,054; U.S. Pat. No. 3,774,658; U.S. Pat. No. 3,568,734; U.S. Pat. No. 3,430,639; EP Pat. No. 568,121 A1; and EP Pat. No. 554,951 A1. While the above-identified fill assemblies have become commercially available for use in association with filler devices, problems associated with precluding air and/or other undesirable matter from entering an associated container before filling as well as uncapping, capping, and/or recapping at an operatively acceptable speed remain largely problematic. Moreover, problems associated with excessive movement and travel of the cap member during uncapping, filling and capping have also been identified. Lastly, certain problems have been encountered relative to the cleaning of the various components of the uncapping and retaining structures.

It is therefore an object of the present invention to provide a reliable, filler device sub-assembly for use in association with any one of a number of filler devices, including rotary fillers, which remedies the detriments and/or complications associated with conventional filler assemblies known in the art.

These and other objects of the present invention will become apparent in light of the present specification, claims, and drawings.

SUMMARY OF THE INVENTION

The invention comprises a filler device sub-assembly having a manipulator for manipulating a cap of a container. The manipulator comprises a first and second cap gripper arm and means for controllably manipulating the cap gripper arms. The cap gripper arms are capable of cooperating to releasably retain a cap of a container. The controllable manipulating means comprises an inner cam assembly, an outer cam assembly and at least one follower. The outer cam assembly extends at least partially about the inner cam assembly. At least one of the outer cam assembly and the inner cam assembly is coupled to the cap gripper arms. The at least one follower is associated with the inner cam assembly and the outer cam assembly. The lifter shaft is associated with at least one of the inner and outer cam assemblies. Movement of the lifter shaft imparts movement of the follower and relative movement of the inner cam assembly and the outer cam assembly, to in turn, longitudinally and rotatably move the cap gripper arms from a first position proximate to a container to a second position distally spaced from a container.

In a preferred embodiment, the inner cam assembly is associated with the lifter shaft, the outer cam assembly is substantially stationary and the inner cam assembly is coupled to the cap gripper arms.

In another preferred embodiment, the outer cam assembly includes at least one slot assembly, which includes an upper slot and a lower slot. Similarly, the inner cam assembly includes at least one slot for each of the at least one slot assemblies of the outer cam assembly. The at least one slot of the inner cam assembly corresponds to one of the upper slot and the lower slot of the outer cam assembly.

In one such embodiment, the at least one slot of the inner cam assembly corresponds to the lower slot of the at least one slot assembly of the outer cam assembly.

In another such embodiment, the at least one follower comprises at least one follower associated with the inner cam assembly and corresponding to one of the upper and lower slots of the at least one slot assembly, and, at least one follower associated with the lifter shaft and corresponding the other of the upper and lower slots of the at least one slot assembly and corresponding to the at least one slot of the inner cam assembly.

In one such preferred embodiment, the at least one slot of each of the inner and outer assemblies which correspond to the at least one follower of the lifter shaft are oblique relative to each other.

In another such embodiment, the at least one slot interfacing with the at least one follower of the inner cam assembly includes a longitudinal section and a rotational section. The positioning of the at least one follower of the inner cam in the longitudinal section facilitates longitudinal movement of at least one of the inner cam assembly and the outer cam assembly. The positioning of the at least one follower of the inner cam in the rotational region facilitates rotational movement of at least one of the inner cam assembly and the outer cam assembly.

In one embodiment, the at least one slot of each of the outer cam assembly and the inner cam assembly interface with the at least one follower of the lifter shaft, to, in turn, control the rotation of the gripper arms upon positioning of the at least one follower of the inner cam assembly within the rotational region of the at least one slot interfacing therewith.

In one such embodiment, at least a portion of the upper slot and at least a portion of the lower slot are substantially collinear.

In another embodiment of the invention, the at least one follower comprises at least two followers, each follower cooperating with at least one of the inner cam assembly and the outer cam assembly. At least one of the at least two followers selectively facilitating one of longitudinal and rotational movement of the cap gripper arms, and, the other of the at least two followers facilitating the rotational movement of the cap gripper arms upon selective facilitation of such rotational movement.

In one embodiment of the invention, the inner cam assembly further comprises a body having a slot and an upper shaft member coupled to the first and second cap gripper arms. The outer cam assembly further comprises an upper slot and a lower slot. The at least one follower comprises at least one follower coupled to the inner cam and cooperating with the one of the upper and lower slots of the outer cam assembly, and at least one follower coupled to the lifter shaft and cooperating with each of the slot of the body of the inner cam assembly and the other of the upper slot and the lower slot. In one such embodiment, the lifter shaft further comprises a first end and a second end. The at least one follower that is associated with the lifter shaft is associated with the first end thereof. The first end of the lifter shaft is rotatively and longitudinally displaceable relative to the inner cam assembly.

In another embodiment, the at least one follower that is coupled to the inner cam cooperates with the upper slot of the outer cam assembly and the at least one follower that is coupled to the lifter shaft cooperates with the lower slot of the outer cam assembly.

Preferably, the upper slot of the outer cam assembly further comprises a longitudinal section and a rotational section. Additionally, the lower slot is substantially collinear with the longitudinal section of the upper slot.

In a preferred embodiment, the lower slot of the outer cam assembly is oblique to the slot of the body of the inner cam assembly.

In another embodiment, the outer cam assembly is substantially fixed and the inner cam assembly is capable of each of longitudinal motion and rotational motion relative to the outer cam.

BRIEF DESCRIPTION OF THE DRAWINGS

The invention will now be described with reference to the drawings wherein.

DETAILED DESCRIPTION OF THE INVENTION

Figure 1:
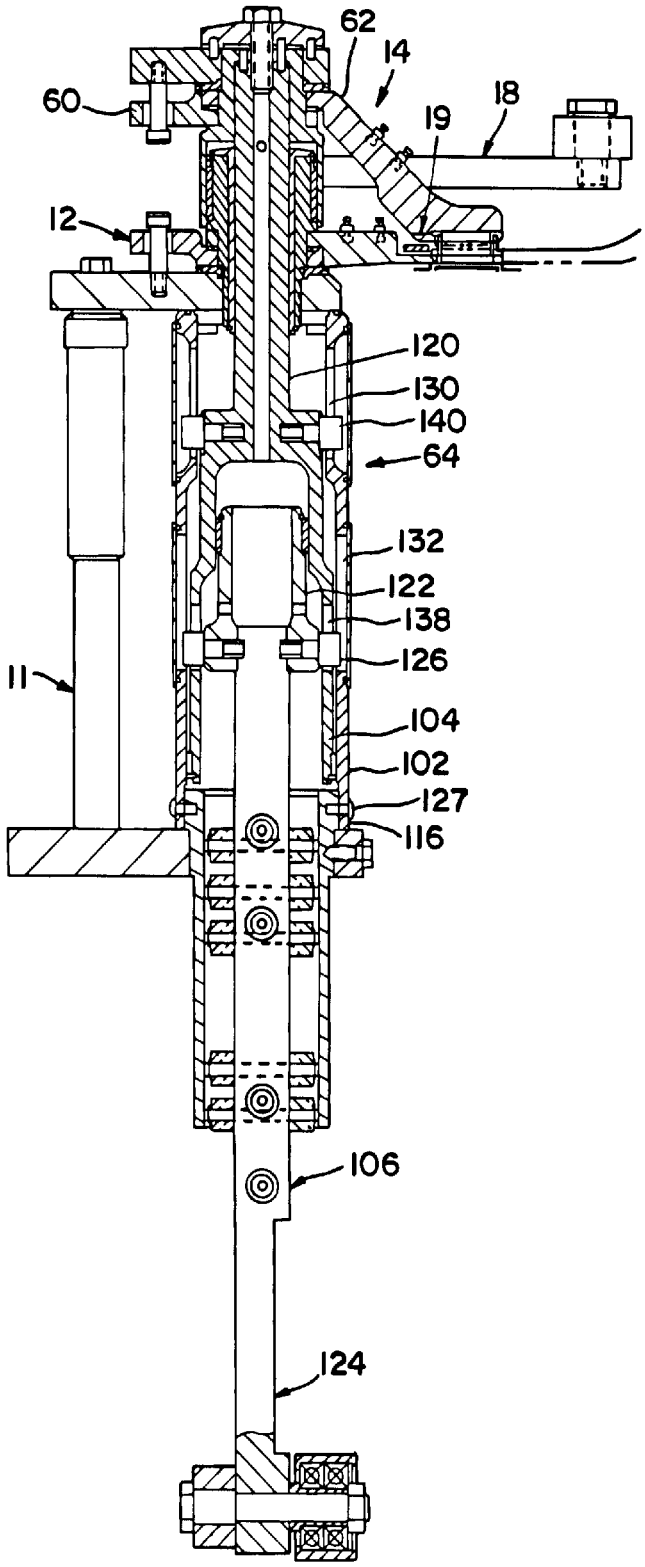
FIG. 1 of the drawings is a cross-sectional view of a filler device sub-assembly in accordance with the present invention showing, in particular, the cap manipulating means.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1 in particular, a schematic representation of a filler device sub-assembly 10 is shown, which generally comprises housing 11, means 12 for retaining a rim of a container, means 14 for manipulating a cap of a container, means 16 for substantially sealing a portion of a container against a rim of a container (FIG. 3), means 18 for ejecting a rim of a container, and means 19 for sensing the presence or absence of at least one of a cap or a rim of a container.

Figure 8:
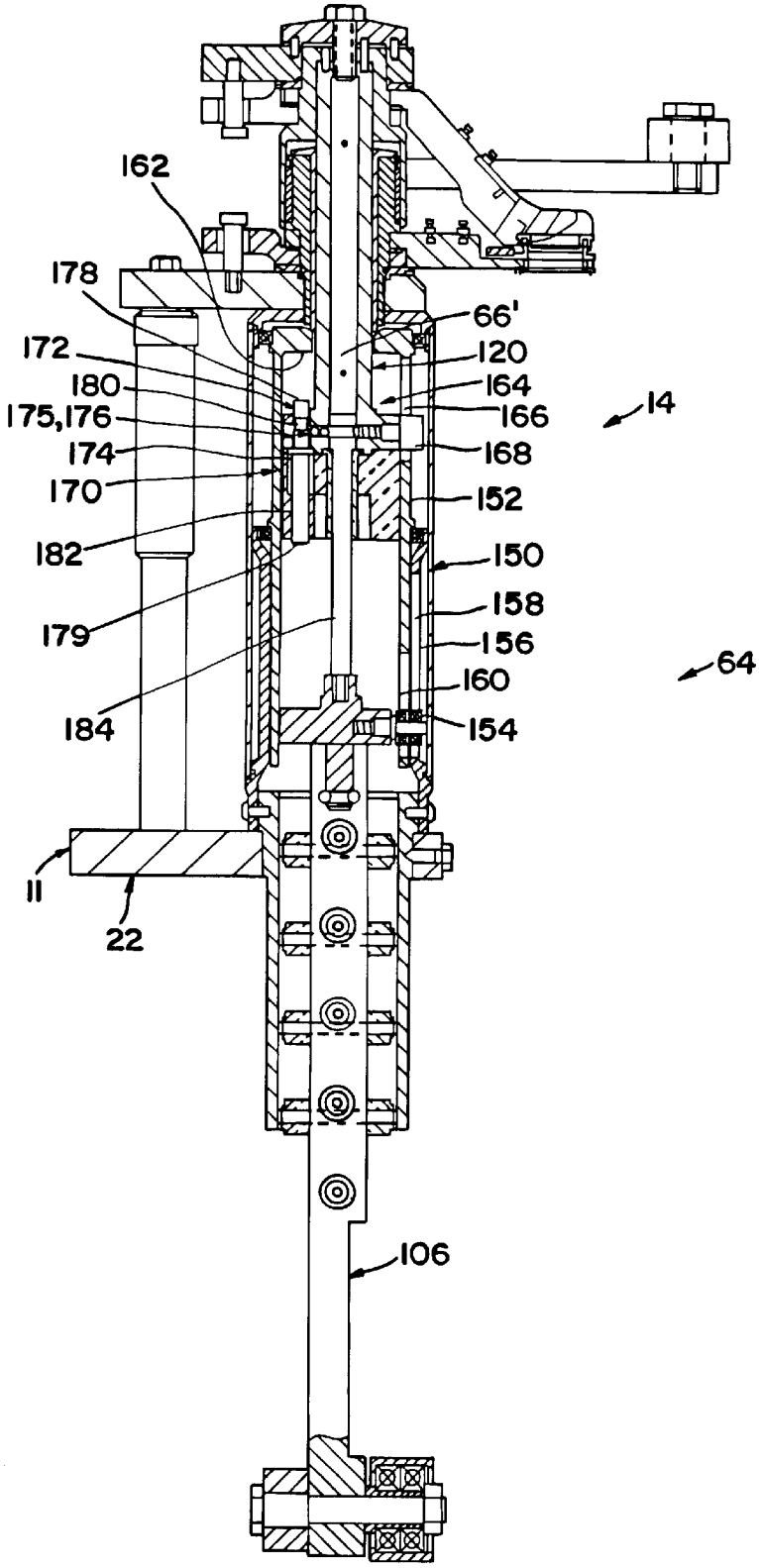
FIG. 8 of the drawings is a fragmentary cross-sectional view of a filler device in accordance with the present invention.
Figure 9:
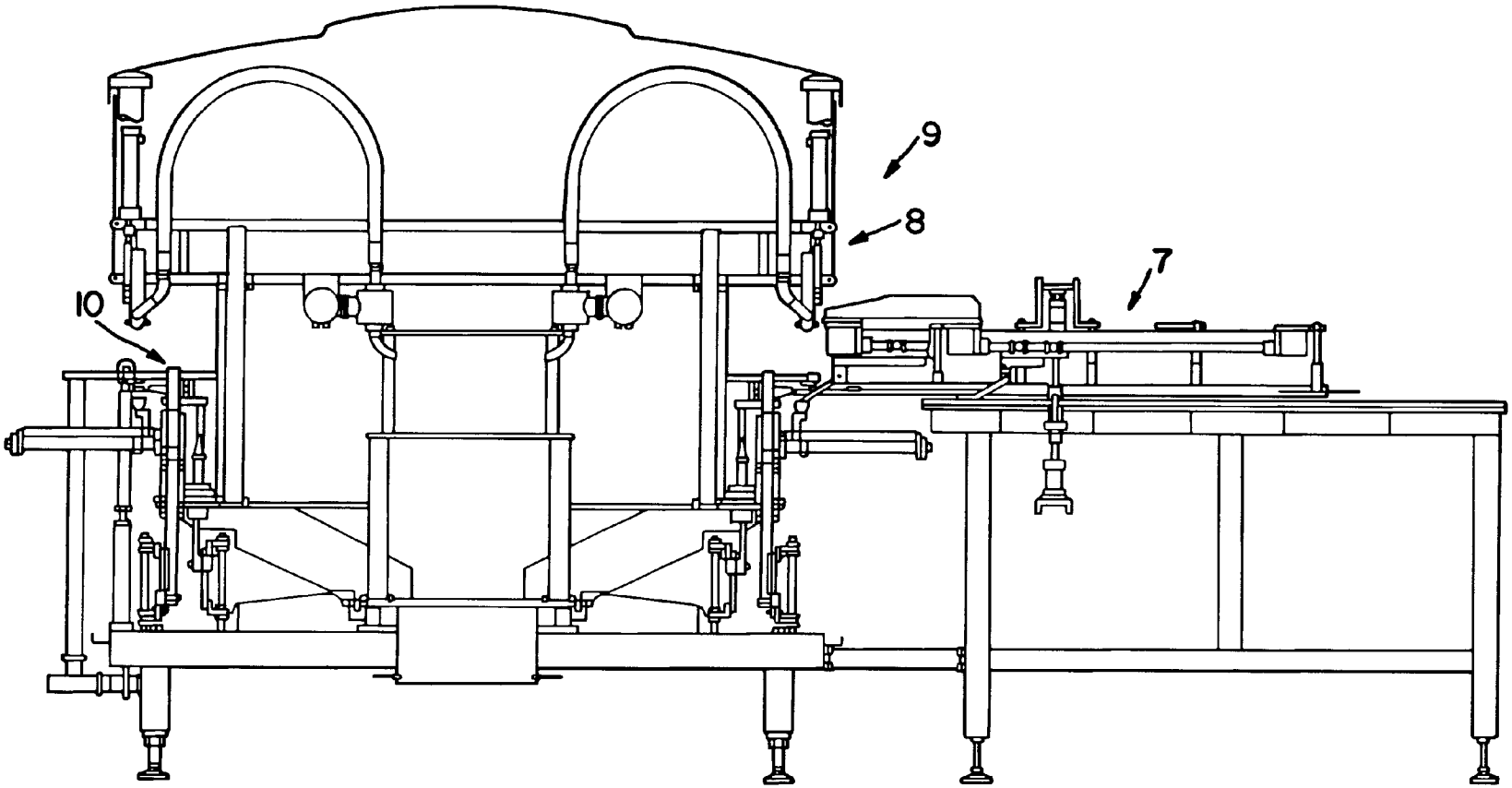
FIG. 9 of the drawings is a side elevational view of a filler device in accordance with the present invention.

Referring now to FIGS. 8 and 9, filler device sub-assembly 10 is primarily intended for use in association with filler device 9, which is capable of filling associated containers and/or bags with any one of a number of materials (i.e. product) in solid, liquid, and/or gaseous states.

Figure 3:
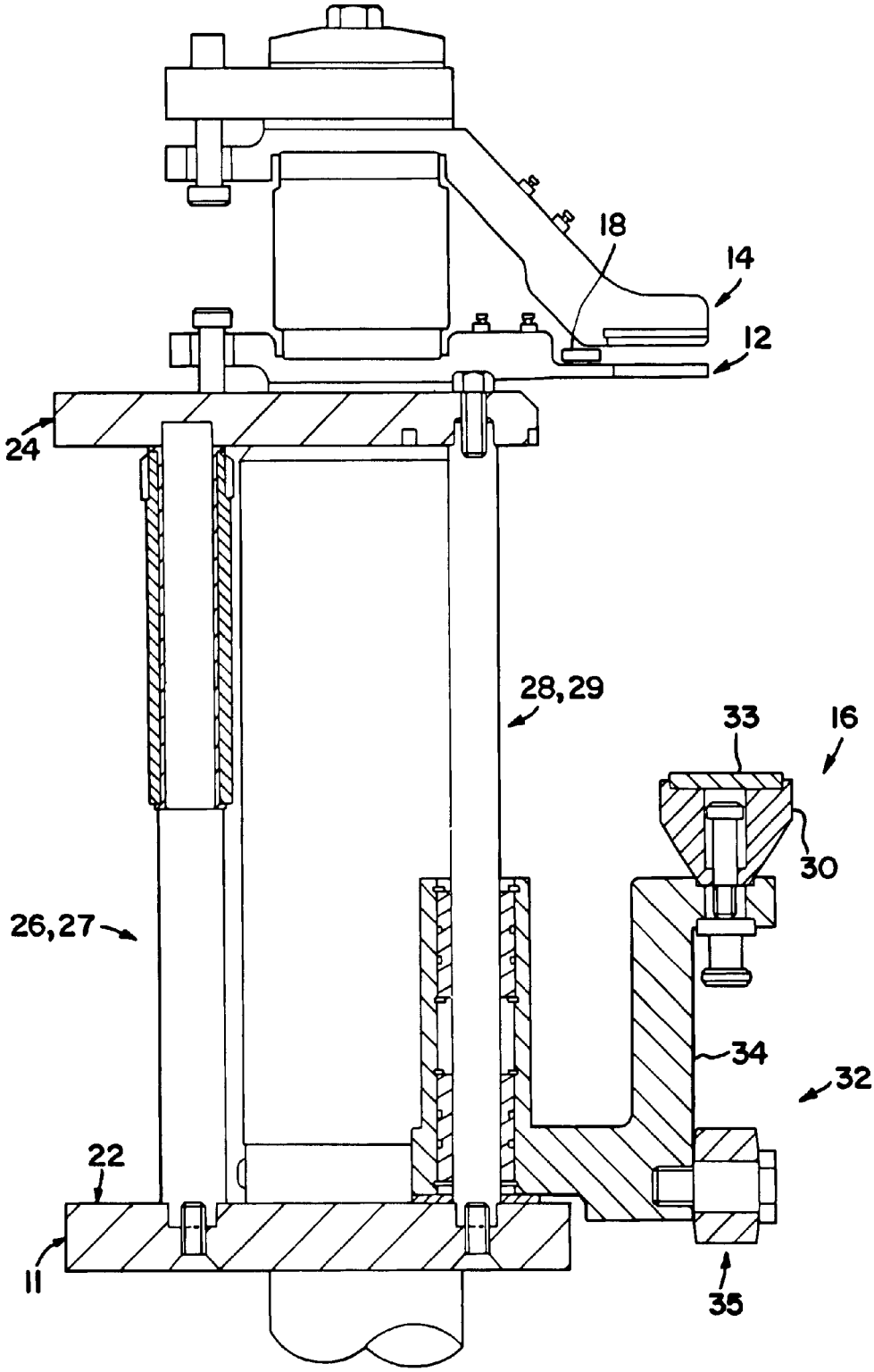
FIG. 3 of the drawings is a fragmentary side elevational view of a filler device sub-assembly in accordance with the present invention taken partially along line A—A and partially along line B—B of FIG. 2B.

Housing 11 is shown in FIG. 3 as comprising base 22, upper plate 24, and riser posts 26, 27, 28 and 29. As will be understood, housing 11 provides a structure for the attachment and operation of the remainder of the filler device sub-assembly components. For example, base 22 includes an opening and upper plate 24 includes an opening for receiving and retaining cap manipulating means 14 and rim retaining means 12. Similarly, and as will be explained in greater detail herein, riser posts 28 and 29 provide a shaft upon which substantial sealing means 16 is linearly slidable. Housing 11 generally comprises a stainless steel material which is resistant to corrosion. Of course, other materials, such as aluminum and non-metals are likewise contemplated for use. Indeed, the housing is not limited to any particular material, and various materials may be utilized depending on the particular application. As shown in FIGS. 11–14 and as will be explained in detail below, in certain embodiments, housing 11 may be optionally equipped with housing cleaning assembly 23.

Figure 2A:
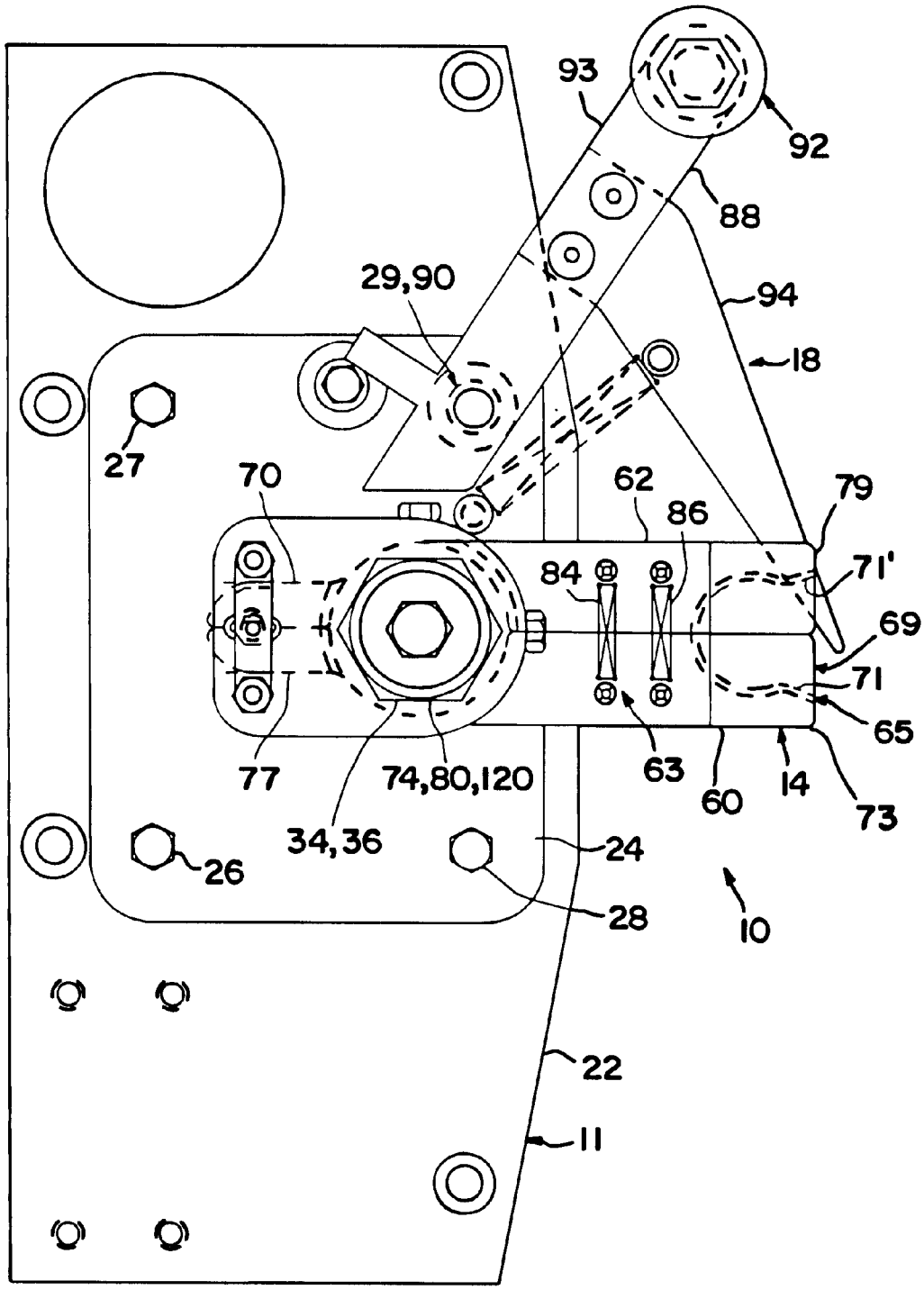
FIG. 2A of the drawings is a fragmentary top view of a filler device subassembly in accordance with the present invention showing, in particular, the cap manipulating means.
Figure 2B:
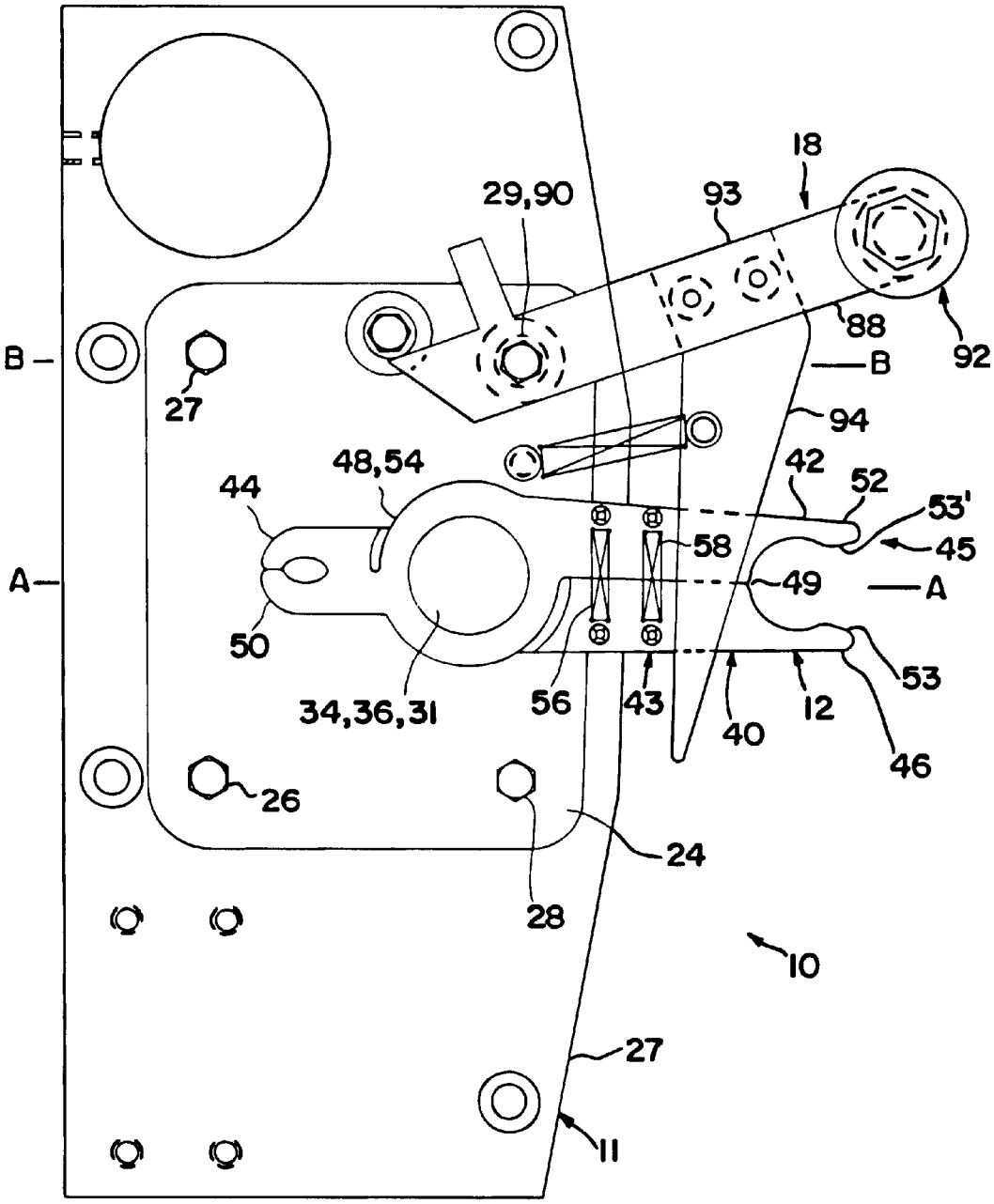
FIG. 2B of the drawings is a fragmentary top view of a filler device subassembly in accordance with the present invention showing, in particular, the rim retaining means.

Rim retaining means 12 is shown in FIG. 2B as comprising first gripper arm 40, second gripper arm 42, pivot axle 41, means 43 for biasing the first gripper arm and the second gripper arm toward each other, and means 45 for guiding the rim into a desired gripped orientation. First gripper arm 40 includes first end 44, second end 46 and pivot opening 48. Similarly, second gripper arm 42 includes first end 50, second end 52 and pivot opening 54. The two gripper arms combine to define rim retaining region 49, which accommodates and retains the rim of a particular container. The gripper arms are pivotally associated with pivot axle 41 which is fixed to the opening of upper plate 24 of housing 11. The pivot openings of the gripper arms are positioned about pivot axle 41 so that the gripper arms can pivot thereabout. In a grasping position, the first ends 44, 50 are in abutment and in contact with a stop, such as stop 47 (FIG. 4) and the second ends are in close proximity. In the extended position, the first ends are away from the stop, and the second ends are separated so as to be ready to receive a rim.

Figure 4:
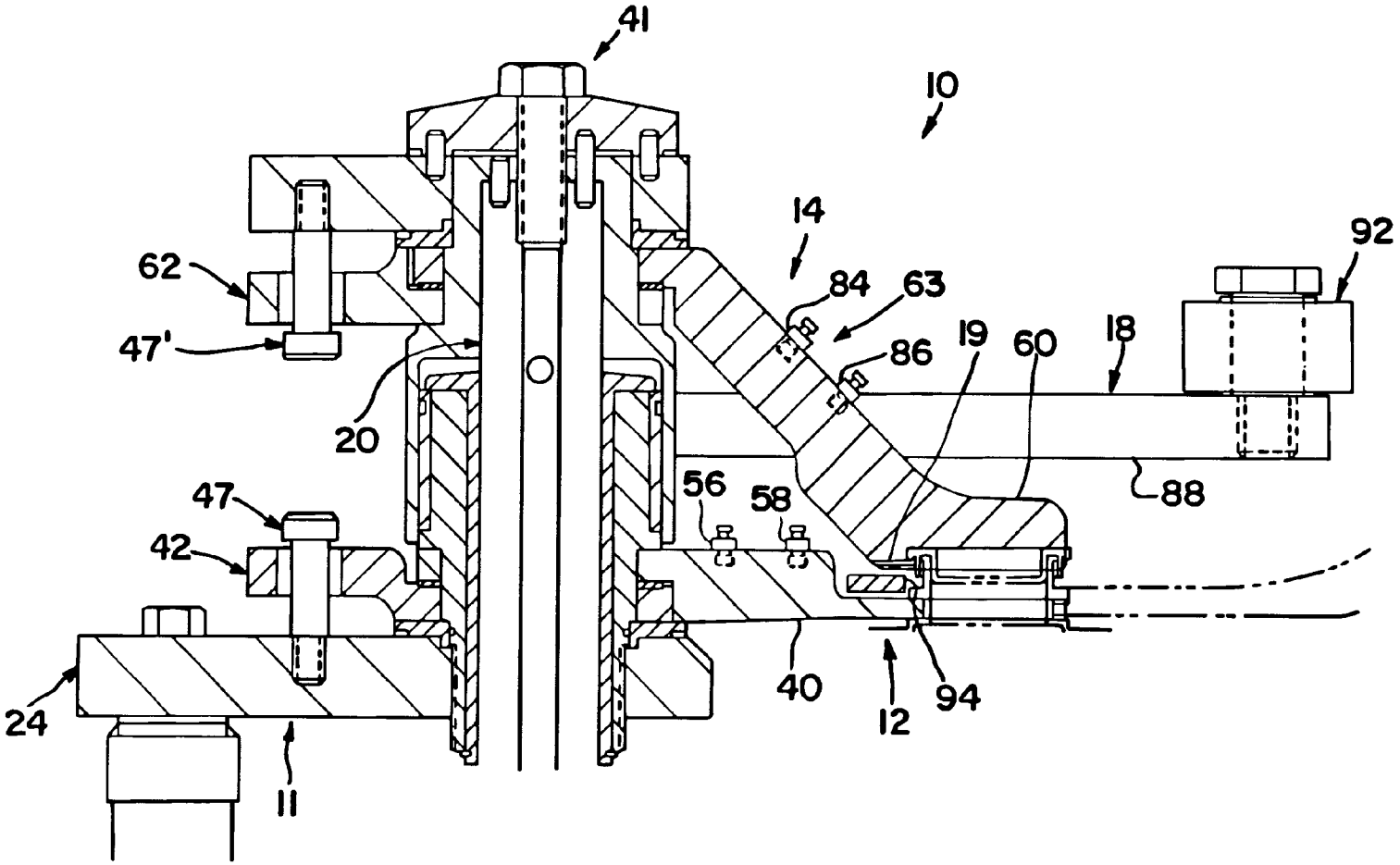
FIG. 4 of the drawings is a fragmentary side elevational view of a filler device sub-assembly in accordance with the present invention taken along line A—A of FIG. 2B showing, among other things, an upper end thereof.

Gripper arm biasing means 43 is shown in FIGS. 2B and 4 as comprising extension springs 56, 58 which are releasably attached to each of the gripper arms. In a steady state condition, the springs are extended, and, in turn, biased such that the second ends of the gripper arms are forced toward and into contact with each other. An external force is required to overcome springs 56, 58, to, in turn, separate the ends of the gripper arms 40, 42 from each other. In other embodiments, the retaining means may comprise compression springs which operate individually on each of the gripper arms. Of course other retaining means, such as gripper arms which utilize a hydraulic force or a pneumatic force to retain a rim are likewise contemplated for use.

Referring again to FIG. 2B, rim guiding means 45 comprises rim extending surfaces 53, 53' which are associated with second ends 46, 52 of the respective first and second gripper arms. The rim extending surfaces are positioned such that upon outside contact, by, for example, a rim of a container, the gripper arms are pivoted away from each other. In addition, the rim extending surfaces are angled toward the rim retaining region such that upon outside contact, by a rim of a container, the rim extending surfaces (that are in contact with the rim) guide the rim toward and into rim retaining region 49. Preferably, the rim extending surfaces are angled toward the rim retaining region at an angle of about 15° to about 75°. To achieve cooperative operation, the two cap extending surfaces are angled at substantially identical angles.

Cap manipulating means 14 is shown in FIG. 2A as comprising first cap gripper arm 60, second cap gripper arm 62, means 63 for biasing the cap gripper arms toward each other, means 64 for controllably manipulating the gripper arms (FIG. 1), means 65 for guiding the cap into a gripped orientation. It will be understood that cap manipulating means 14 removes the cap from the container and directs the cap away from the container so that a fill valve can be introduced to the container, and the resulting container may be filled. Subsequently, the cap manipulating means returns the cap to the container so that the container can be resealed.

Specifically, as is shown FIG. 2A, first cap gripper arm 60 includes first end 70, second end 73 and pivot opening 74. Similarly, second cap gripper arm 62 includes first end 77, second end 79 and pivot opening 80. As with the gripper arms 40, 42 of rim retaining means 12, cap gripper arms 60, 62 likewise define cap gripping region 69 which is configured to accept and retain caps of a particular configuration.

The cap gripper arms 60, 62 are arranged so that the pivot openings 74, 80 are positioned to pivot about the axis of upper shaft member 120, from a grasping position to a released position. In a grasping position, the first ends are in abutment and in contact with a stop, such as stop 47', and the second ends are positioned in close proximity. In the extended position, the first ends are away from the stop and the second ends are separated so as to be ready to receive a cap.

As is shown in FIG. 2A, biasing means 63 forces cap gripper arms 60, 62 into a retaining position. Specifically, biasing means 63 includes extension springs 84, 86 which are releasably attached to each of the cap gripper arms to bias them toward each other. External force is required to overcome the springs so as to separate the ends of the cap gripper arms away from each other.

Cap guiding means 65 is shown in FIG. 2A as comprising cap extending surfaces 71, 71' associated with the respective second ends of the cap gripper arms. As with the rim retaining means, the cap extending surfaces are configured so that contact by, for example, a cap of a container, directs the cap gripper arm (in contact with the cap of a container) in an outward direction and simultaneously guides the cap toward cap gripping region 69. To achieve this guiding of the cap, the cap extending surfaces are angled at an angle of about 15° to about 75°. To achieve substantially cooperative operation, the two cap extending surfaces are angled at substantially identical angles and at angles substantially identical to the rim extending surfaces 53, 53'.

Gripper arm controllable manipulating means 64 is shown in FIG. 1 as comprising outer cam assembly 102, inner cam assembly 104 and lifter shaft 106. The gripper arm controllable manipulating means is capable of vertically moving (i.e., longitudinally moving) the cap from the rim of the container and rotatingly moving the cap away from the rim to permit the valve to engage the container and, in turn, fill same. Outer cam assembly 102 and inner cam assembly 104 are configured such that they are substantially coaxial with outer cam assembly 102 extending around inner cam assembly 104, while other configurations are contemplated.

Figure 5:
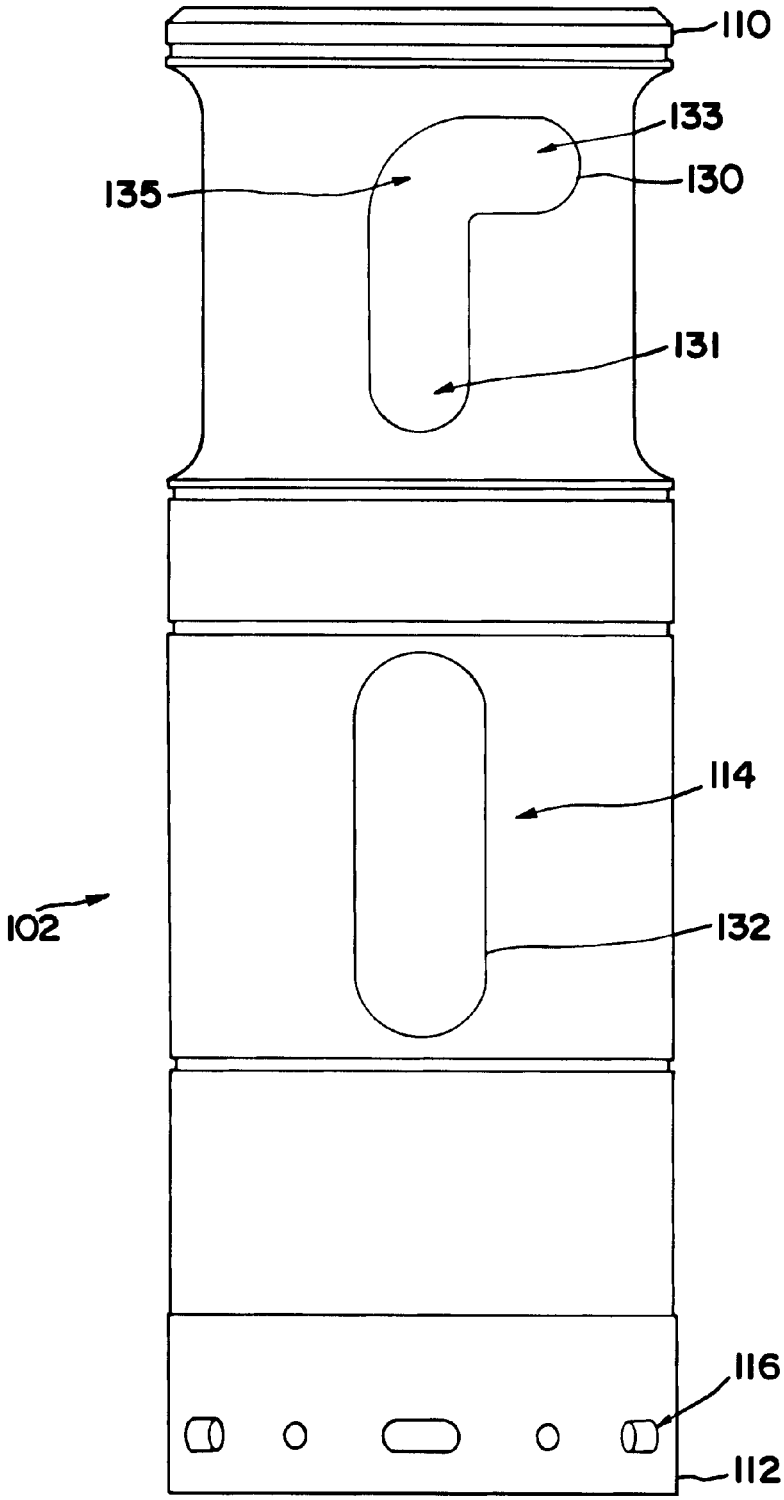
FIG. 5 of the drawings is a side elevational view of a filler device sub-assembly in accordance with the present invention showing, in particular, an outer cam assembly thereof.

Outer cam assembly 102 is shown in detail in FIG. 5 as comprising first end 110, second end 112, slot assembly 114 and attachment assembly 116. It will be understood that while a single slot assembly 114 is shown in FIG. 5, outer cam 102 includes three slot assemblies positioned at 120° intervals about the circumference of the outer cam assembly. Of course a greater or a fewer number of slot assemblies are contemplated for use, and, various spatial arrangements are likewise contemplated for use. Slot assembly 114 is shown as comprising upper slot 130 and lower slot 132. Upper slot 130 includes a substantially inverted "L-shaped" configuration, including longitudinal section 131, rotational section 133 and transition section 135. Lower slot 132 is substantially vertical. Longitudinal section 131 is substantially collinear with lower slot 132. Of course, various different configurations are likewise contemplated which achieve similar functional results. Attachment assembly 116 comprises a plurality of openings which correspond to openings on base 22 of housing 11, or on a structure which is secured thereto. Outer cam assembly 102 can be secured to housing 11 by way of fasteners, such as fasteners 127 (FIG. 1) which extend through attachment assembly 116. Of course, it is contemplated that the attachment assembly may comprise, for example, an interference fit, welding, a friction fit, adhesive, etc. Indeed, the invention is not limited to any particular attachment assembly.

Figure 6:
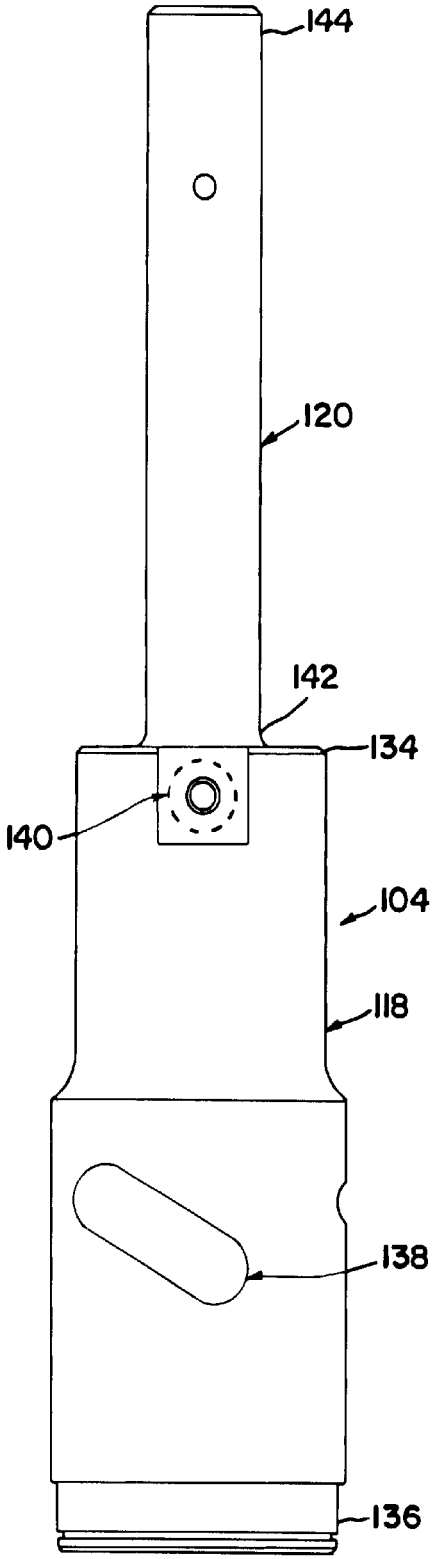
FIG. 6 of the drawings is a side elevational view of a filler device sub-assembly in accordance with the present invention showing, in particular, an inner cam assembly thereof.

Inner cam assembly 104 is shown in detail in FIG. 6 as comprising body 118 and upper shaft member 120. In the embodiment shown, body 118 and upper shaft 120 comprise a single integrated member. Of course, in other embodiments, the body and the upper shaft may comprise a plurality of separate components. Body 118 includes first end 134, second end 136, at least one slot, such as slot 138, and follower 140. In the embodiment shown, three slots 138 and three followers 140 are positioned in a spaced apart relationship about the circumference of body 118. Slot 138 is inclined at a desired angle with respect to the upper shaft. Each of the slots 138 are positioned about body 118 between the first and second ends thereof such that when the inner cam and the outer cam are assembled, slots 138 spatially correspond to lower slots 132 (FIG. 5) of outer cam assembly 102 (FIG. 5) and are oblique thereto. The particular angle at which the slot is positioned can be varied depending the desired movement characteristics of the particular embodiment. For example, the length and the slope of slot 138 controls the rate of rotation and the arcuate rotation is controlled by the travel of lifter shaft 106. Of course, other variables in addition to the slope affect the rate at which the inner cam rotates.

Follower 140 is positioned proximate first end 134 of body 118. Follower 140 is configured about body 118 such that when the outer cam assembly and the inner cam assembly are interfaced, follower 140 will extend through a respective upper slot 130 of upper cam assembly 120.

Upper shaft member 120 is shown in FIG. 6 as comprising first end 142 and second end 144. First end 142 is attached to first end 134 of body 118. Second end 144 emanates generally upwardly therefrom and is attached to the gripper arms 60, 62 (FIG. 1).

Lifter shaft 106 is shown in FIG. 1 as comprising first end 122, second end 124 and a plurality of followers, such as, follower 126. First end 122 is positioned within the inner and outer cams proximate the first end of inner cam assembly 104. Follower 126 is associated with first end 122 and configured so as to interface with each of lower slot 132 of slot assembly 114 of outer cam assembly 102 and with slot 138 of inner cam assembly 104. Second end 124 extends downwardly away from first end 122 and interfaces with a control mechanism (not shown) which can control the vertical movement of the lifter shaft as desired.

As is shown in FIG. 3, substantial sealing means 16 includes pad housing 30 and linear movement means 32. It will be understood that the substantial sealing means substantially seals the volume within the interior of the container from the outside of the rim of the container prior to and after filling a sufficient amount so as to preclude contamination of the container as the cap is removed and replaced. Pad housing 30 includes fill pad 33 and slidable housing 34. Slidable housing 34 is slidably positioned on risers 28, 29 of housing 11. Linear bearings or the like may be utilized to facilitate the controlled low-friction movement of the slidable housing about risers 28, 29.

Linear movement means 32, is shown in FIG. 3 as comprising, force means 35 for upwardly directing pad housing 30 and means for downwardly directing pad housing 30 which direct slidable housing 34 between a first position proximate base 22 of housing 11 and a second position proximate upper plate 24 of housing 11. Upward moving means 35 may comprise a cam actuated by the rotative movement of the sub-assembly relative to the remainder of filler device 9 (FIG. 9), a pneumatic device, hydraulic device or electric device which is capable of overcoming return springs (not shown) mounted on riser posts 28, 29 and to direct slidable housing 34 toward upper plate 24 of housing 11. The return springs return the slidable housing toward and preferably into contact with base 22 of housing 11. Of course, other assemblies which return pad housing 30 from upper plate 24 to base 22, including fully pneumatic, hydraulic or electric systems are contemplated for use.

Rim ejecting means 18 is shown in FIGS. 2A and 2B as comprising lever member 88, rotation pivot 90 and means 92 for rotating the lever member about the rotation pivot. Lever member 88 includes bar 93 and arm 94. Lever member 88 is configured so that, upon rotation about the rotation pivot, arm 94 is directed across second ends 46, 52 of the gripper arms of rim retaining means 12, to, in turn, dislodge and release a container retained by gripper arms 40, 42—as well as an associated cap. Rotating means 92 comprises a cam (not shown) which actuates, to, in turn, rotate the lever member about the rotation pivot. Various means for rotating the lever member are contemplated for use, including, but not limited to, pneumatic, hydraulic, electrical, or mechanical power.

Sensing means 19 is shown in FIG. 4 as comprising at least one sensor positioned upon at least one of the rim retaining means and the cap gripping means. In one embodiment, the at least one sensor comprises a proximity type sensor associated with the cap gripping means and/or the rim retaining means. As such, the sensor facilitates the determination as to the presence or absence of a cap or a rim. Such a system can be alerted to a fault condition, and, in turn, the filling operation can be stopped in the event that a container rim or a cap is not present. Of course, other sensors, such as micro-switches, and/or optical sensors are contemplated for use in accordance with the present invention. While various configurations are contemplated, such sensors may be positioned on one or both of the rim gripping arms and/or the cap gripping arms.

Figure 10:
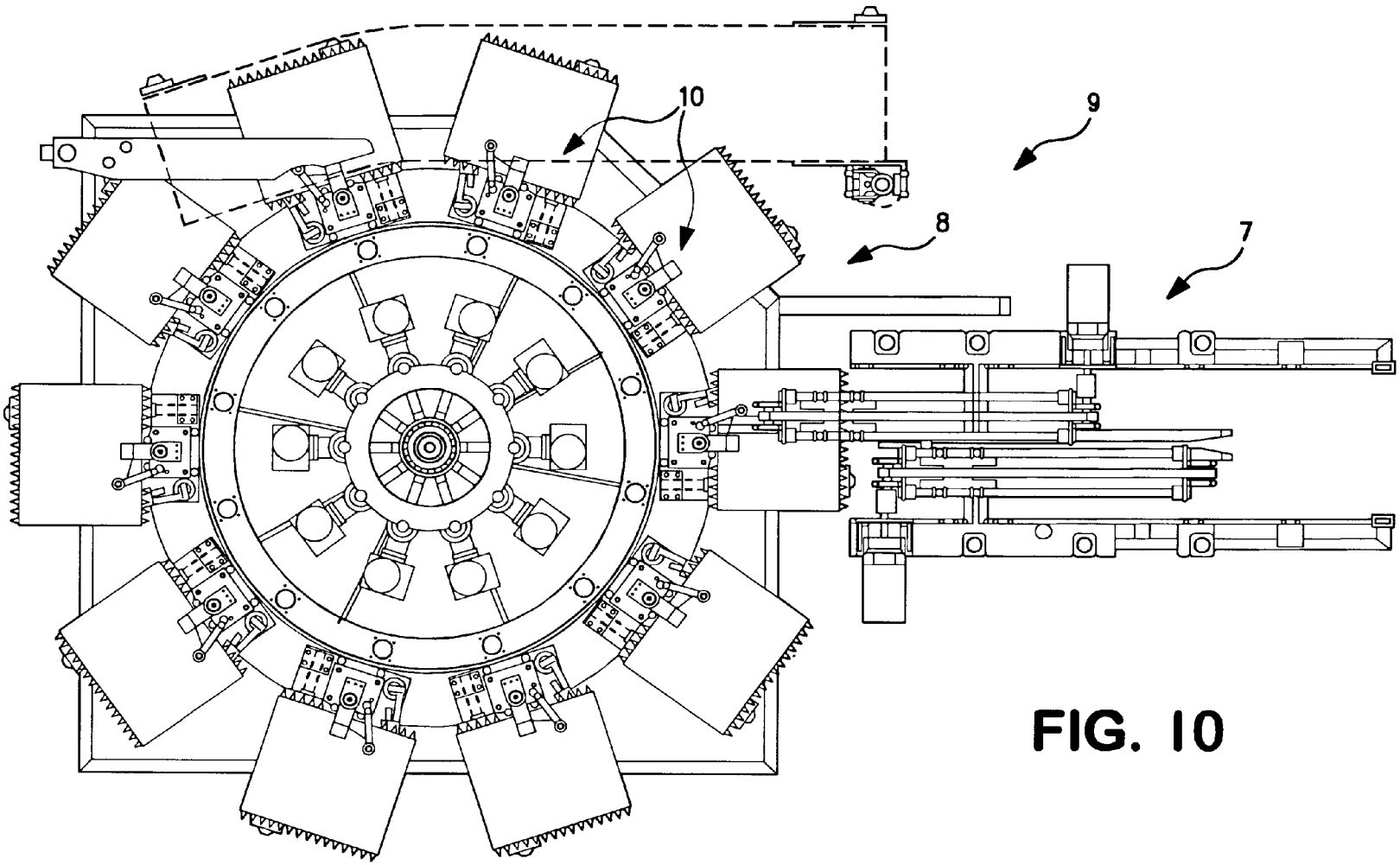
FIG. 10 of the drawings is a top view of a filler device in accordance with the present invention.

In operation, and as is shown in FIGS. 9 and 10, filler device sub-assembly 10 is associated with filler device 9. Filler device 9 includes such assemblies 10 for each of the ten separate fill stations on rotating carousel 8. Of course, any number of assemblies are contemplated for use.

With reference to FIGS. 1 and 3, to prepare the assembly for receipt of a container, pad housing 30 of substantial sealing means 16 is placed in a first position wherein slidable housing 34 is positioned away from upper plate 24 and preferably proximate base 22 of housing 11. Similarly, lifter shaft 106 is positioned at or near its lowest position. In such a position, cap gripper arms 60, 62 are proximate upper plate 24 and substantially aligned with the rim gripper arms.

Once properly configured, a container is supplied via container feed 7 (FIGS. 9 and 10). Referring now to FIGS. 2A and 2B, as the container contacts first and second gripper arms 40, 42 of rim retaining means 12, and first and second cap gripper arms 60, 62 of cap manipulating means 14, the container rim contacts rim extending surfaces 53, 53' and the cap contacts cap extending surfaces 71, 71'. As the container (rim and cap) continue to move, the movement overcomes respective biasing means 43 and 63 and spreads the respective second ends of the gripper arms apart as the rim extending surfaces 53, 53' and the cap extending surfaces 71, 71' center the rim and cap, and, in turn, direct same into the respective retaining regions 49, 69. Once the cap and rim are received by the respective receiving regions 49, 69 defined by the second ends of the gripper arms, the respective biasing means direct the gripper arms toward each other so as to grasp and retain the rim and cap in a desired engaged position.

After the rim is retained by first and second rim gripper arms 40, 42, and after the cap is retained by first and second cap gripper arms 60, 62, substantial sealing means 16 maybe activated (Of course, in certain embodiments, the substantial sealing means may be modified and/or omitted from the process entirely). Referring now to FIG. 3, in turn, linear moving means 32 is powered to move pad housing 30. Specifically, upward moving means 35 of linear moving means 32 overcomes the return springs, and moves slidable housing 34 associated with pad housing 30 toward upper plate 24 of housing 11. As the slidable housing 34 approaches upper plate 24, fill pad 33 engages the lower surface of the container, which, in turn, engages a lower surface of the rim of the container. However, in certain instances it may be positioned such that the product within the container is displaced by the pad such that the product engages the lower surface of the rim of the container. As the slidable housing is forced upward, the lower surface of the container (or product within the container) becomes engaged with the lower surface of the rim and the volume defined by the container is substantially sealed and/or substantially isolated.

Next, the control mechanism imparts vertically upward movement of the lifter shaft. As a result, follower 126 of the lifter shaft begins to interact with each of lower slot 132 and slot 138 of the outer cam assembly and the inner cam assembly, respectively. Contemporaneously, follower 140 mounted upon body 118 of inner cam assembly 104 begins to interact with upper slot 130. Such interaction of the slots directs the upper shaft member 120 in an upward direction. In particular, while the angled configuration of slot 138 would impart rotation of the inner cam relative to the outer cam, the cooperation of follower 140 with longitudinal portion 131 of upper slot 130 precludes rotative motion of the inner cam relative to the outer cam, and, instead substantially maintains the two cam assemblies substantially rotatively locked relative to each other. Thus, during this step, the gripper arms proceed in a longitudinal, or upward, direction detaching the cap from the rim.

Figure 7:
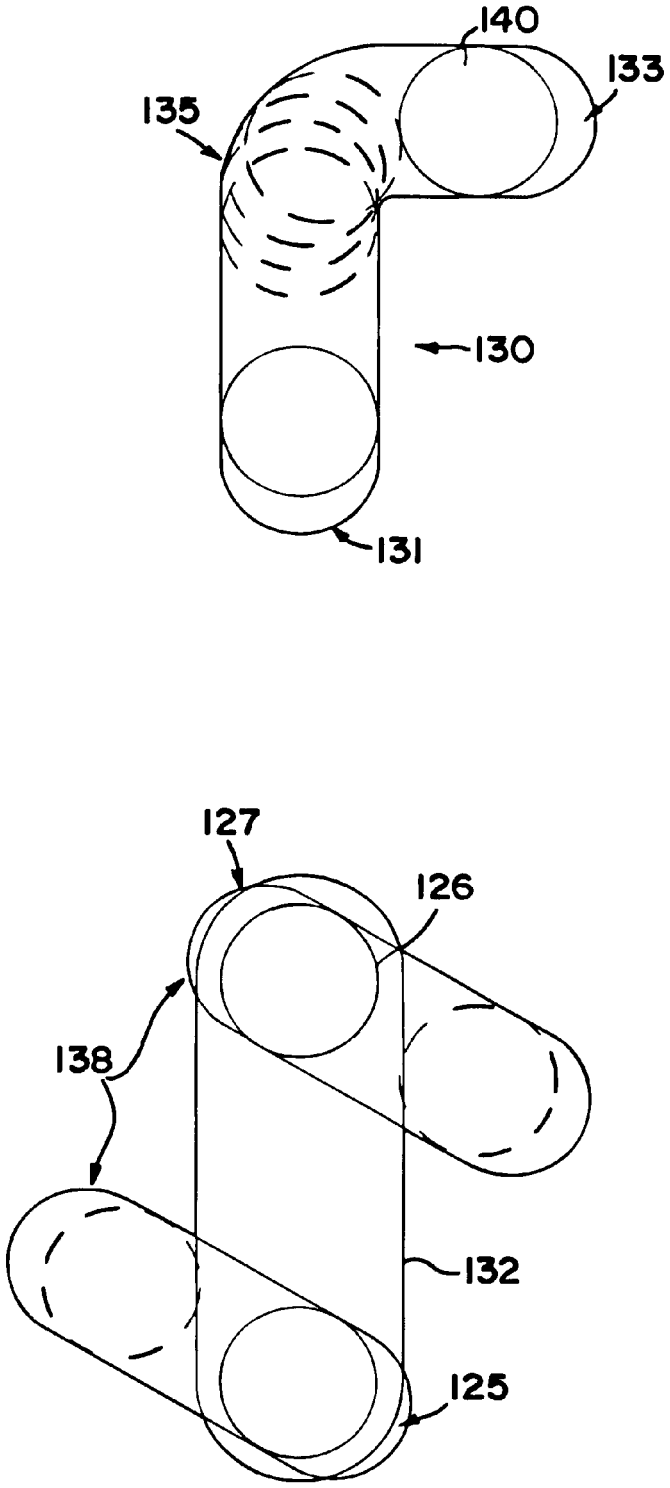
FIG. 7 of the drawings is a schematic representation of the travel of the followers associated with the cap gripper arm controllable manipulating means.

As follower 140 reaches transition portion 135 of upper slot 130, further upper movement of upper shaft member 120 is precluded. Thus, in such a position, the inner cam and the outer cam are longitudinally locked relative to each other, in the vertical direction. Through further upward movement of the lifter shaft, the inner cam assembly is rotated about a longitudinal axis by the interaction of follower 126 within each of slots 138 and 132. Contemporaneously, follower 140 translates about the rotational portion 133 of upper slot 130. Through such movement, the cap gripper arms, which to this point had vertically displaced the cap from the rim, are rotated away from the rim, thereby providing the valve assembly substantially unfettered access to the rim for filling of the container. Of course, it is contemplated that the slots can be configured in various configurations to impart varying degrees of rotation upon the cap gripper arms. In sum, as shown in FIG. 7, follower 140 proceeds from region 131 to region 133 within upper slot 130. Similarly, follower 126 proceeds from position 125 to position 127 relative to each of slots 132, 138.

As, or after, the upper shaft member, gripper arms, and cap rotate away from the rim of the container, the fill valve is freely moved into position proximate the rim of the container. Once the fill valve is positioned into substantial engagement with the rim, slidable housing 34 is moved away from upper plate 24, toward base 22 of housing 11. At such time, the lower surface of the container (or the product) disengages from the rim thereby placing the volume defined by the container in fluid communication with fill valve. Subsequently, the fill valve is actuated, and the container is filled.

After the container is filled with product as desired, slidable housing 34 may be forced upward by upward moving means 35 until it again substantially seals the lower surface of the container relative to the lower rim of the container or product, to substantially isolate the fill valve from the volume defined by the container. Next, the fill valve is disengaged.

Once the valve is disengaged, the lifter shaft is directed by the control mechanism in a downward direction. Through downward movement of the lifter shaft, the interaction of follower 126 with slots 138 and 132 directs the inner cam assembly to rotate relative to the outer cam assembly. At the same time, the interaction between follower 138 and upper slot 130 facilitates the rotation of the cam assemblies relative to each other, but precludes longitudinal relative movement of the inner cam assembly and the outer cam assembly. Due to the motion of the inner cam assembly, the cap gripper arms, which are attached to the upper shaft member 120 of the inner cam assembly 104, rotationally return to a position substantially overlying the rim.

As lifter shaft 106 proceeds in the downward direction, follower 140 enters longitudinal portion 131 of upper slot 130. Slot 130 substantially rotationally locks the outer cam assembly relative to the inner cam assembly but facilitates longitudinal relative movement of same. Thus, as the lifter shaft continues in the downward direction, the inner cam likewise proceeds in a downward direction until follower 140 reaches at least one of the bottom of upper slot 130 and the bottom of lower slot 132 or until the lifter shaft stops movement. Correspondingly, at the conclusion of such movement of the lifter shaft, the gripper arms have lowered so as to force the cap onto the rim retained by the rim retaining means. In sum, as is shown in FIG. 7, at the completion of the downward movement of the lifter shaft, follower 140 returns to section 131 and follower 126 returns to position 125.

Once the cap reseals the container, upward moving means 35 is disengaged, and the return springs return slidable housing 34 toward base 22 of housing 11. Next, the container is removed from the fill assembly by way of rim ejecting means 18. Specifically, rotating means 92 directs the rotation of lever member 88 about rotation pivot 90. As lever member 88 rotates, arm 94 pushes against the rim of the container. In turn, the force of the arm against the container overcomes biasing means 43 of rim retaining means 12 and biasing means 63 of cap manipulating means 14 thereby separating first and second gripper arms 40, 42, and first and second cap gripper arms 60, 62. Once these are separated, the continued rotation of the lever member expels the rim and the cap from the gripper arms. Once disengaged, the container can be removed from the fill device. The lever member is returned to its original position, and the assembly is again ready to accept another container. The cycle is now ready to be repeated.

In a second embodiment, shown in FIG. 8, controllable cap gripper manipulating means 64 comprises inner cam 152, outer cam 156 and means 164 for controlling rotation of upper shaft member 120 relative to lifter shaft 106. Outer cam 156 is fixedly associated with base 22 of housing 11. Outer cam 156 includes cam surface 158 which comprises a substantially vertical cam surface upon which follower 154 is permitted to travel.

Inner cam 152 includes cam surface 160 and upper end 162. Cam surface 160 substantially corresponds to and cooperates with cam surface 158 of outer cam 156. The specific shape of cam surface 160 comprises a vertical section combined with an upwardly angled extension. Inner cam 152 is coaxially positioned within outer cam 156 such that inner cam 152 is capable of rotating within the confines of outer cam 156. As will be explained, follower 154 travels along cam surface 160 of inner cam 152 simultaneously with travel along surface 158 of outer cam 156.

Upper shaft member rotation controlling means 164 is shown in FIG. 8 as comprising slot 166, roller 168 and locking assembly 170 (FIG. 8). As shown in FIG. 8, slot 166 extends vertically along inner cam 152. Roller 168 is fixedly associated with upper shaft member 120 and travels vertically upward and downward within the confines of slot 166. As such, upper shaft member is capable of traveling vertically relative to inner cam 152, but the interface and interaction of roller 168 and slot 166 preclude relative rotative movement of upper shaft member 120 and inner cam 152.

Locking assembly 170 includes pin 172, means 174 for upwardly biasing pin 172, locking spheres 175, 176, sphere receiver 177. Pin 172 includes top end 178, bottom end 179 and cavity region 180. Biasing means 174 comprises spring 182 which directs pin 172 in an upward direction. Sphere receiver 177 comprises a cavity which is associated with lifter shaft 106. As will be explained in detail below, when spring 182 is biasing the pin in an upward direction, pin 172 forces locking spheres 175, 176 in a first position wherein one of the locking spheres interfaces with sphere receiver 177 on lifter shaft 106, thereby locking the lifter shaft and the upper shaft member to each other. To the contrary, when the biasing force of spring 182 is overcome and pin 172 is directed downward, cavity region 180 of pin 172 aligns with locking spheres 175, 176 such that the locking spheres 175, 176 return to a second position wherein one of the spheres interfaces with cavity region 180, and the spheres no longer interface with sphere receiver 177. In turn, upper shaft member 120 is then free to move relative to lifter shaft 106. As will be explained, when in the second position, vertical movement of lifter shaft 106 directs the end of connecting rod 184 into the lifter shaft into interior region 66' of upper shaft member 120.

In operation of such an embodiment, after the cap and rim are retained and the substantial seal is created between the rim and the lower surface of the container (as described with respect to the first embodiment), the cap manipulating means is activated and directs the lifter shaft in an upward direction. The upward movement first directs the gripper arms away from the rim, thereby removing the cap from the rim.

The continued upward movement directs follower 154 against cam surface 160 of inner cam 152 and cam surface 158 of outer cam 156. During this time, spring 182 of locking assembly 170 maintains pin 172 in an upward orientation. In turn, locking spheres 175, 176 are in a first position wherein the lifter shaft and the upper shaft member are locked together and the movement of the lifter shaft coincides with the movement of the upper shaft member. In addition, the movement of the upper shaft member directs roller 168 to proceed vertically along slot 166 of upper shaft member controlling means 164.

As the vertical movement of the upper shaft member and lifter shaft proceeds, top end 178 of pin 172 is forced into contact with upper end 162 of inner cam 152. At such time, upper end 162 overcomes the force of spring 182 and forces pin 172 in a relative downward direction. The relative downward movement of pin 172 eventually aligns cavity region 180 with locking spheres 175, 176, such that the locking spheres return to a second position free from locked contact and interaction with lifter shaft 106 and connecting rod 184, collectively. At such time, upper shaft member 120 is freely movable relative to lifter shaft 106 and connecting rod 184 collectively.

As further upward movement of lifter shaft 106 is imparted, connecting rod 184 proceeds into cavity 66' of upper shaft member 120. In addition, due to the vertically inclined configuration of cam surface 160 of inner cam 152, follower 154 directs the inner cam to rotate along with upper shaft member 120 relative to housing 11. Such rotation continues until the follower reaches the upper end of the respective cam surfaces 160, 158, or when no further upward movement of the lifter shaft is realized. At such time, the gripper arms, and the respective cap positioned therein have been moved both upwardly and rotatively away from the rim of the container, and the filling procedure can be completed.

Once the container has been properly filled, lifter shaft 106 begins its downward movement. Such downward movement directs the follower to rotate inner cam 152, and upper shaft member 120 to the initial orientation which the capper gripper overlies the rim of the container. Eventually, the connecting rod 184 reaches the end of its travel relative to upper shaft member 120, and further downward movement thereof likewise moves upper shaft member 120 in a downward direction. Next, pin 172 remains static as upper shaft member 120 axially displaces about the same. At the same time, spring 182 directs pin 172 in a relative upward direction. In turn, locking spheres 175, 176 are forced into a first position wherein the connecting rod 184 is again locked to the upper shaft member. Continued movement along the path of the cam surfaces 158, 160 returns the upper shaft member and the lifter arm to the original position wherein the cap is again repositioned upon the rim of the container.

Figure 11:
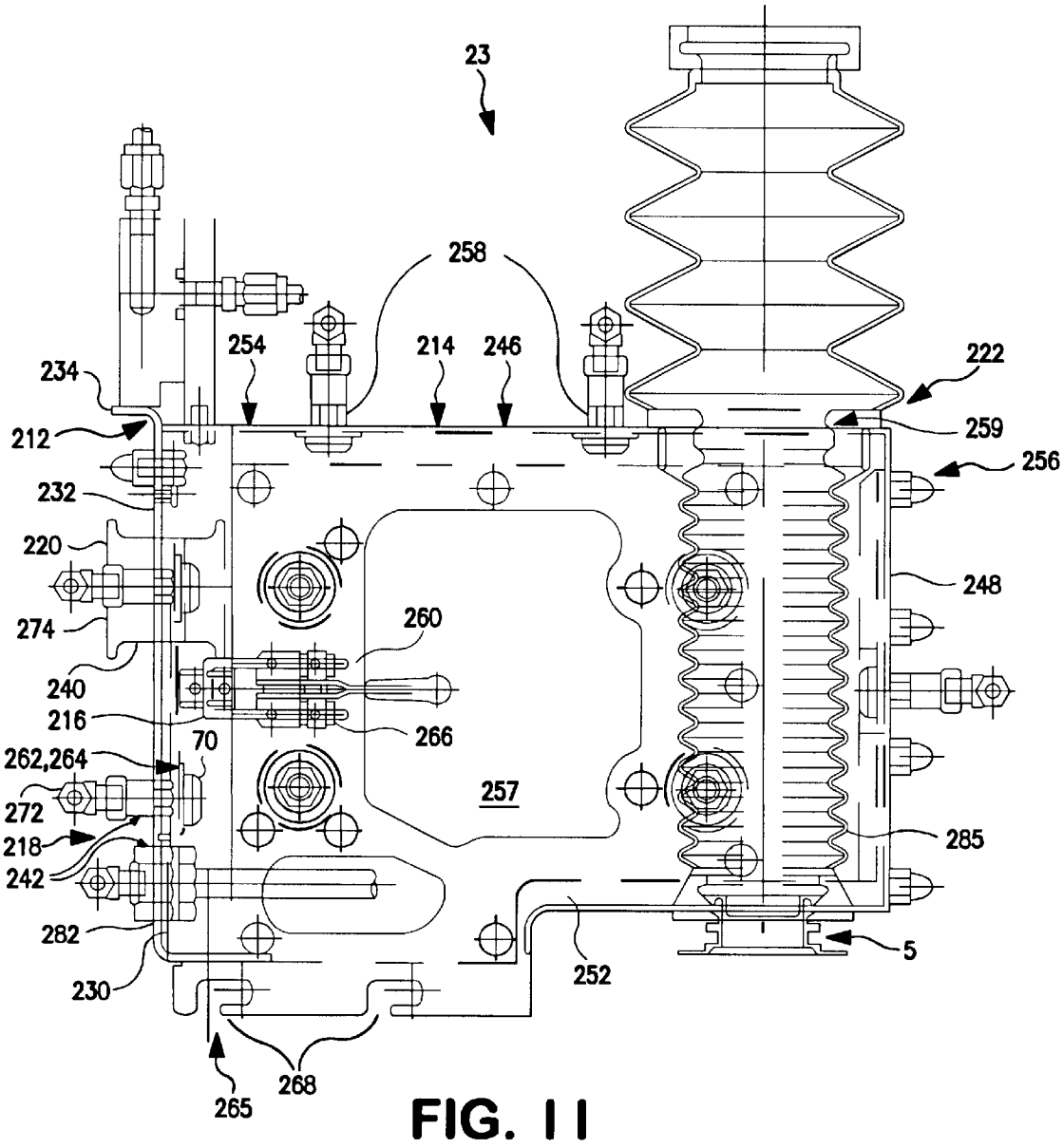
FIG. 11 of the drawings is a side elevational view of a housing cleaning assembly fabricated in accordance with the present invention.

In certain embodiments, such as, for example, embodiments used for the filling of food and other consumable products, housing cleaning assembly 23, as is shown in FIGS. 11–14, may further be associated with housing 11, and in particular mounted to upper plate 24 of the housing. Specifically, housing cleaning assembly 23 is shown in FIG. 11 as comprising mounting plate 212, means 214 for containing a portion of the capping turret, means 216 for attachment of the containing means to the mounting plate, means 218 for cleaning a portion of the capping turret, means 220 for providing a positive pressure gradient between the housing cleaning assembly and the surroundings, and means 222 for isolating a fill valve associated with the capping turret as well as, for example, opening 5 of the container to be filled by the fill valve. One such fill valve is disclosed in U.S. Pat. No. 6,338,370 B1 entitled "FILL VALVE ASSEMBLY FOR FILLER DEVICES AND ASSOCIATED METHOD," the entire disclosure of which is hereby incorporated herein by reference.

Figure 13:
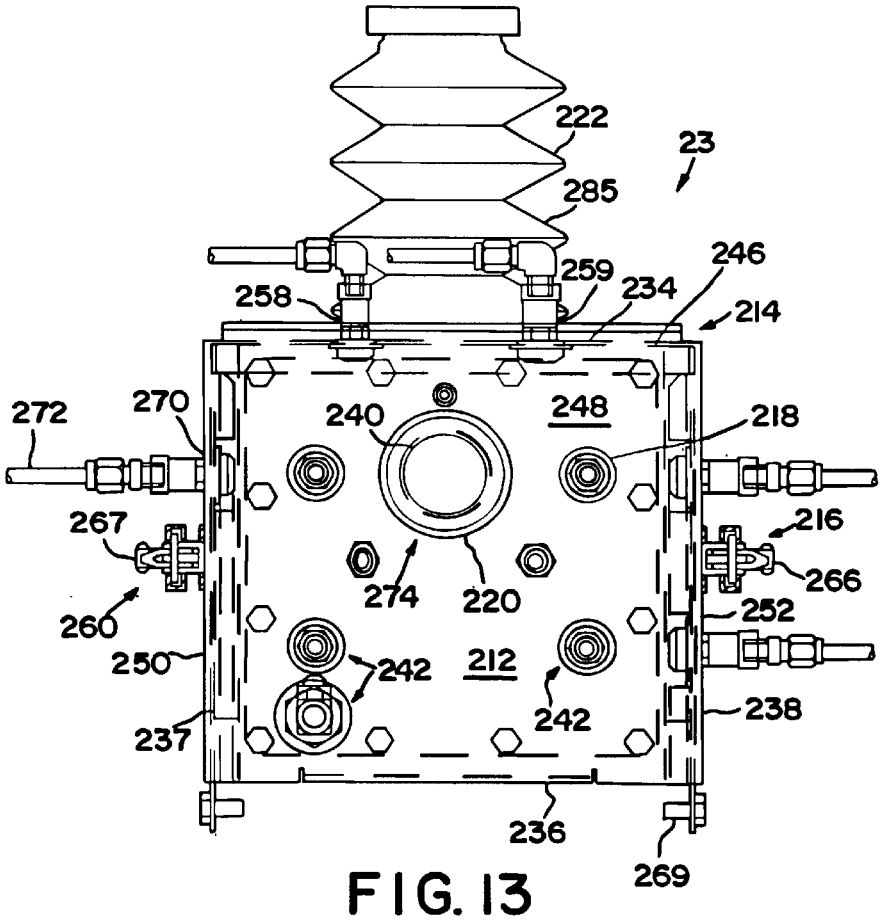
FIG. 13 of the drawings is a back elevational view of a housing cleaning assembly fabricated in accordance with the present invention.

Mounting plate 212 is shown in detail in FIGS. 111 and 13, collectively, as comprising a substantially planar member having front surface 230, back surface 232, upper edge 234, lower edge 236 and side edges 237,238, respectively. In addition, mounting plate 212 includes pressure opening 240 and a plurality of cleaning openings, such as cleaning opening 242. As will be explained below in detail, pressure opening 240 is associated with positive pressure gradient means 220 and cleaning openings 242 are associated with cleaning means 218. Mounting plate 212 is releasably and integrally associated with the frame of the capping turret and/or the filling apparatus itself, and is substantially stationary relative to the capping turret.

Figure 12:
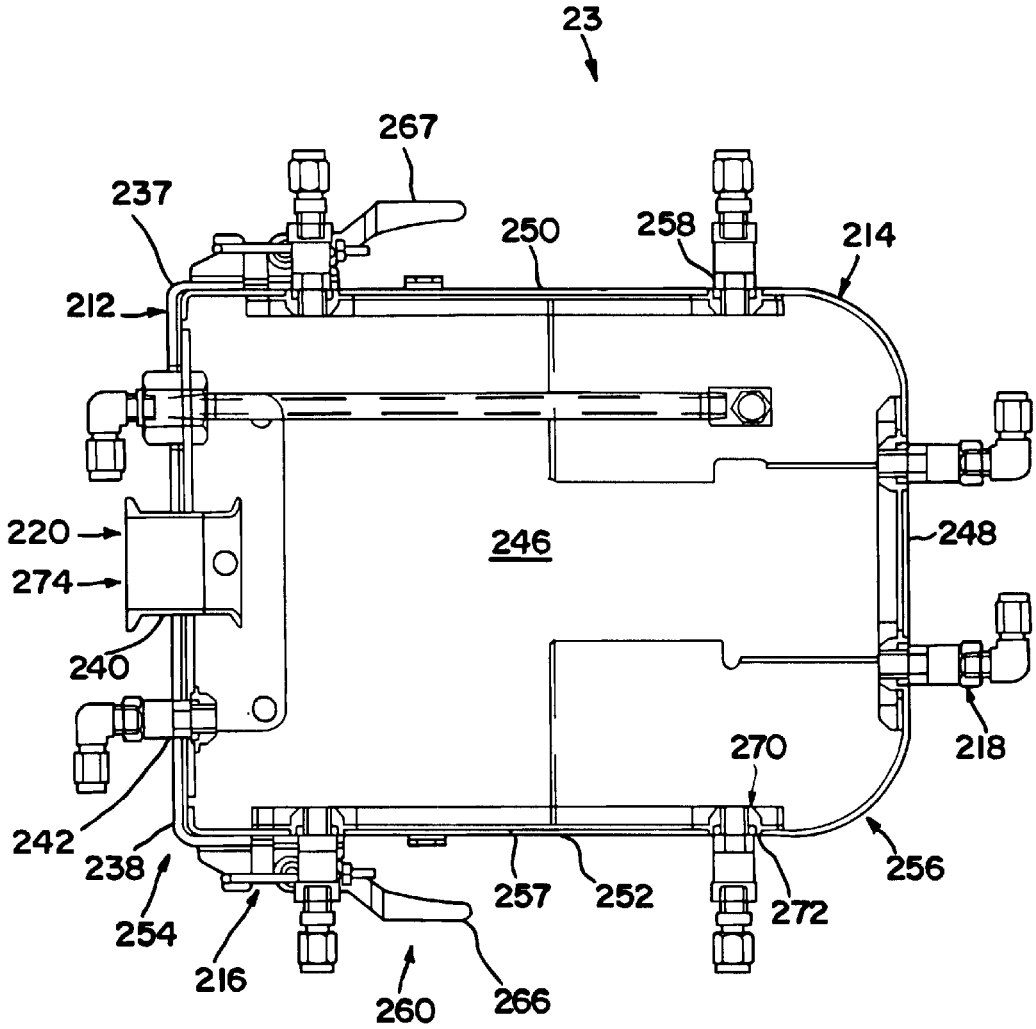
FIG. 12 of the drawings is a partial top plan view of a housing cleaning assembly fabricated in accordance with the present invention.

Containment means 214 is shown in FIGS. 11 and 12, collectively, as comprising top panel 246, front panel 248, and side panels 250, 252, respectively. The top and side panels include proximal end 254 and distal end 256. Proximal end 254 is associated with front surface 230 of mounting plate 212. Top panel 246, as is shown in FIG. 11, includes cleaning openings, such as cleaning opening 258, and isolation opening 259. As will be understood, cleaning openings 258 cooperate with cleaning means 218 and isolation opening 259 cooperates with isolation means 222. The front and side panels of containment means 214 likewise include cleaning openings, such as cleaning opening 258 as well as means 257 for observing the interior of housing cleaning assembly 23. The observing means may comprise a clear member, such as a plexiglass or tempered glass window which permits visual inspection of the containment means of the housing cleaning assembly.

Figure 14:
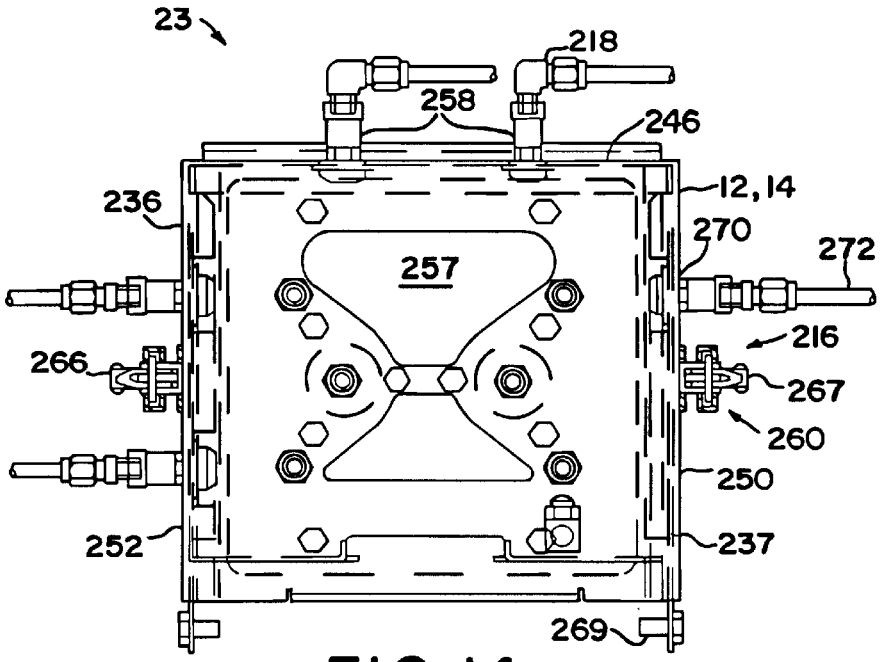
FIG. 14 of the drawings is a front elevational view of a housing cleaning assembly fabricated in accordance with the present invention.

Attachment means 216 is shown in FIG. 11 as comprising means 260 for clamping containment means 214 to mounting plate 212, means 262 for sealing the containment means to mounting plate 212 and means 265 for securing the containment means to the capping turret (not shown). Clamping means 260, as is shown in FIGS. 12–14, includes first clamp 266 and second clamp 267. First clamp 266 is associated with side panel 252 of containment means 214 and side edge 238 of mounting plate 212. Second clamp 267 is associated with side panel 250 of containment means 214 and side edge 237 of mounting plate 212.

Referring once again to FIG. 11, sealing means 262 comprises gasket 264 which is positioned on one or both of front surface 230 of mounting plate 212 and proximal end 254 of any of top panel 246 and side panels 250, 252 of containment means 214. It will be understood, as the clamps of clamping means 260 are actuated, gasket 264 is sandwiched between the respective portions of the mounting plate and containment means so as to provide a substantially fluid-tight seal therebetween.

Securing means 265 is shown in FIGS. 11 and 13, collectively, and includes attachment regions, such as attachment region 268 associated with side panels 250, 252 of containment means 214, and, fasteners, such as fasteners 269. The fasteners are associated with the capping turret or the frame of the filler device and attachment region 268 is fastened thereby to the respective capping turret or frame. In certain embodiments, such as the embodiment shown in FIG. 11, the attachment regions 268 comprise c-channels which facilitate the removing and repositioning of the containment means without complete removal of fasteners 269.

Cleaning means 218 is shown in FIGS. 11–14 as comprising a plurality of cleaning nozzles 270 which are associated with supply lines 272. The supply lines are associated with one or more fluid pressure lines capable of providing a supply at a predetermined elevated pressure. Cleaning nozzles 270 extend through at least some of the cleaning openings 242 of mounting plate 212 and the cleaning openings 258 of containment means 214. The nozzles can be positioned in particular orientations and positions so as to be capable of effectively providing fluid (e.g., cleaning fluid, disinfecting fluid, water, etcetera) to all of the desired regions of housing cleaning assembly 23. The particular orientation, quantity and operating pressure of the nozzles can be determined through experimentation.

Positive pressure gradient means 220 is shown in FIG. 12 as comprising inlet 274 which is associated with a pressure supply. Inlet 274 extends through pressure opening 240 of mounting plate 212. Generally, the pressure supply comprises a pressurized air supply which is capable of providing a particular supply rate and pressure of air through inlet 274 into the cavity defined by the mounting plate and containment means. As will be explained, the providing of pressurized air into the cavity tends to maintain debris, dust and other contaminants (such as insects, bacteria and other biological matter) outside of the housing cleaning assembly, and likewise serves to expel the cleaning fluid from within the housing cleaning assembly.

Isolating means 222 is shown in FIG. 11 as comprising bellows 285 which is capable of moving in an upward and downward direction with the movement of the elements of the capping turret and/or fill valve, while substantially precluding the ingress of fluid from the nozzles of cleaning means 218. Isolating means 222 also isolates containment means 214 from external exposure and/or contamination. While various materials are contemplated for use, isolating means 222 is preferably fabricated from a natural and/or synthetic plastic or rubber of requisite flexibility and durability.

To assemble housing cleaning assembly 23, mounting plate 212 is first associated with the frame of a capping turret, or the capping turret itself. Once associated, the mounting plate is secured thereto. Next, the containment means is positioned in the proper orientation wherein the proximal end of the containment means is proximate front surface 230 of mounting plate 212. In particular, attachment regions 268 are positioned in the proper orientation relative to respective fasteners 269.

Next, mounting plate 212 and containment means 214 are attached to each other via attachment means 216. Clamps 266 and 267 of clamping means 260 are secured and serve to compress gasket 262 positioned between the mounting plate and the containment means. At such time, any members of the fill device which are positioned within isolating means 222 are so positioned. For example, in the embodiment shown, the fill valve is positioned so as to be within isolating means 222. Lastly, the fasteners 269 may optionally be tightened so as to restrain attachment regions 268 in secured retention.

Once fully secured, the respective supply lines 272 of cleaning means 218 are associated with the respective nozzles 270 and with the fluid supply tank or line. Likewise, inlet 274 of positive pressure gradient means 220 is associated with a proper supply. Once fully connected, the device is prepared for operation.

In operation, the cleaning means 218 can be selectively activated so as to deliver fluid through the respective nozzles at a predetermined supply pressure and for a predetermined duration. The fluid contacts the surfaces of predetermined regions within containment means 214, such as, for example a capping turret, and disinfects and/or cleans the same. As the fluid is sprayed, under the force of gravity, the fluid falls down through containment means 214 to the ground or to drains positioned below the housing cleaning assembly.

At the same time, positive pressure gradient means 220 can be activated to supply pressurized air into the containment means so as to force the fluid from the cleaning means 218 out of the housing cleaning assembly. Furthermore, the positive pressure gradient means 220 can continue to operate even after the cleaning means has been deactivated to aid in the drying of the components within the housing cleaning assembly and to keep airborne pollutants from entering the housing cleaning assembly.

During operation of each and/or both of the cleaning means and the positive pressure gradient means, the operator can view the operation of same through the transparent observation means associated with the containment means.

Due to the positioning and construction of isolating means 222, components such as the fill valve assembly and other sensitive components can be substantially unaffected by the operation of the cleaning means and the positive pressure gradient means within housing cleaning assembly 23. Moreover, isolating means 222 can isolate containment means from external environments.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A filler device sub-assembly having a manipulator for manipulating a cap of a container, the manipulator comprising:

first cap gripper arm and a second cap gripper arm, the first cap gripper arm and second cap gripper arm being capable of cooperating to releasably retain a cap of a container; and means for controllably manipulating the first and second cap gripper arms comprising:

an inner cam assembly;

an outer cam assembly extending at least partially about the inner cam assembly, at least one of the outer cam assembly and the inner cam assembly coupled to the first and second cap gripper arms; and at least one follower associated with the inner cam assembly and the outer cam assembly, whereupon movement of the follower imparts a relative movement of the inner cam assembly and the outer cam assembly, to in turn, longitudinally and rotatably move the first and second cap gripper arms from a first position proximate to a container to a second position distally spaced from a container.

2. The filler device sub-assembly of claim 1 wherein:

the at least one follower comprises at least two followers, each follower cooperating with at least one of the inner cam assembly and the outer cam assembly, at least one of the at least two followers selectively facilitating one of longitudinal and rotational movement of the first and second cap gripper arms, and, the other of the at least two followers facilitating rotational movement of the first and second cap gripper arms upon selective facilitation of such rotational movement.

3. The filler device sub-assembly of claim 1, further comprising a lifter shaft, wherein:

the inner cam assembly further comprises:

a body having a slot; and an upper shaft member coupled to the first and second cap gripper arms;

the outer cam assembly further comprising:

an upper slot and a lower slot;

the at least one follower comprises at least one follower coupled to the inner cam and cooperating with the one of the upper and lower slots of the outer cam assembly, and at least one follower coupled to the lifter shaft and cooperating with each of the slot of the body of the inner cam assembly and the other of the upper slot and the lower slot.

4. The filler device sub-assembly of claim 3 wherein the lifter shaft further comprises:

a first end and a second end, the at least one follower associated with the lifter shaft being associated with the first end thereof; and the first end of the lifter shaft being rotatively and longitudinally displaceable relative to the inner cam assembly.

5. The filler device sub-assembly of claim 3 wherein:

the at least one follower coupled to the inner cam cooperates with the upper slot of the outer cam assembly; and the at least one follower coupled to the lifter shaft cooperates with the lower slot of the outer cam assembly.

6. The filler device sub-assembly of claim 5 wherein:

the upper slot of the outer cam assembly further camprises a longitudinal section and a rotational section; and the lower slot is substantially collinear with the longitudinal section of the upper slot.

7. The filler device sub-assembly of claim 5 wherein:

the lower slot of the outer cam assembly is oblique to the slot of the body of the inner cam assembly.

8. The filler device sub-assembly of claim 1 wherein:

the outer cam assembly is substantially fixed and the inner cam assembly is capable of each of longitudinal motion and rotational motion relative to the outer cam.

9. A filler device sub-assembly having a manipulator for manipulating a cap of a container, the manipulator comprising:

first cap gripper arm and a second cap gripper arm, the first cap gripper arm and second cap gripper arm being capable of cooperating to releasably retain a cap of a container; and means for controllably manipulating the first and second cap gripper arm comprising:

an inner cam assembly;

an outer cam assembly extending at least partially about the inner cam assembly, at least one of the outer cam assembly and the inner cam assembly coupled to the first and second cap gripper arms;

at least one follower associated with the inner cam assembly and the outer cam assembly; and a lifter shaft associated with at least one of the inner and outer cam assemblies, whereupon movement of the lifter shaft imparts movement of the follower and relative movement of the inner cam assembly and the outer cam assembly, to in turn, longitudinally and rotatably move the first and second cap gripper arms from a first position proximate to a container to a second position distally spaced from a container.

10. The filler device sub-assembly of claim 9 wherein:

the inner cam assembly is associated with the lifter shaft;

the outer cam assembly is substantially stationary; and the inner cam assembly is coupled to the first and second cap gripper arms.

11. The filler device sub-assembly of claim 9 wherein:

the outer cam assembly includes at least one slot assembly, the at least one slot assembly including an upper slot and a lower slot;

the inner cam assembly including at least one slot for each of the at least one slot assembly of the outer cam assembly, the at least one slot of the inner cam assembly corresponding to one of the upper slot and the lower slot of the outer cam assembly.

12. The filler device sub-assembly of claim 11 wherein:

the at least one slot of the inner cam assembly corresponds to the lower slot of the at least one slot assembly of the outer carn assembly.

13. The filler device sub-assembly of claim 11 wherein the at least one follower comprises:

at least one follower associated with the inner cam assembly and corresponding to one of the upper and lower slots of the at least one slot assembly; and at least one follower associated with the lifter shaft and corresponding the other of the upper and lower slots of the at least one slot assembly and corresponding to the at least one slot of the inner cam assembly.

14. The filler device sub-assembly of claim 13 wherein the at least one slot of each of the inner and outer assemblies which correspond to the at least one follower of the lifter shaft are oblique relative to each other.

15. The filler device sub-assembly of claim 13 wherein:

the at least one slot interfacing with the at least one follower of the inner cam assembly includes a longitudinal section and a rotational section, such that the positioning of the at least one follower of the inner cam in the longitudinal section facilitates longitudinal movement of at least one of the inner cam assembly and the outer cam assembly, and the positioning of the at least one follower of the inner cam in the rotational section facilitates rotational movement of at least one of the inner cam assembly and the outer cam assembly.

16. The filler device sub-assembly of claim 15 wherein:

the at least one slot of each of the outer cam assembly and the inner cam assembly interfacing with the at least one follower of the lifter shaft, to, in turn, control the rotation of the first and second cap gripper arms upon positioning of the at least one follower of the inner cam assembly within the rotational section of the at least one slot interfacing therewith.

17. The filler device sub-assembly of claim 15 wherein at least a portion of the upper slot and at least a portion of the lower slot are substantially collinear.

18. A filler device sub-assembly having a manipulator for manipulating a cap of a container, the manipulator comprising:

first cap gripper arm and a second cap gripper arm, the first cap gripper arm and second cap gripper arm being capable of cooperating to releasably retain a cap of a container; and means for controllably manipulating the first and second cap gripper arms comprising:

an inner cam assembly having at least one slot, at least one follower and an upper shaft member coupled with the first and second cap gripper arms;

an outer cam assembly having at least one slot assembly comprising at least one lower slot and at least one upper slot, the outer cam assembly extending at least partially about the inner cam assembly; and a lifter shaft associated with the inner cam assembly, the lifter shaft including at least one follower associated therewith, the at least one follower of the inner cam assembly corresponding to the at least one upper slot of the outer earn assembly, the at least one follower of the lifter shaft corresponding to the at least one slot of the inner cam assembly and to the lower slot of the outer cam assembly, whereupon movement of the lifter shaft imparts movement of the respective followers and relative movement of the inner cam assembly and the outer cam assembly, to in turn, longitudinally and rotatably move the first and second cap gripper arms from a first position proximate to a container to a second position distally spaced from a container.

19. The filer device sub-assembly of claim 18 wherein:

the at least one upper slot of the outer cam selectively facilitates longitudinal and rotational movement of the first and second cap gripper arms; and the at least one lower slot of the outer cam and the at least one slot of the inner cam cooperate to control the rate of rotational movement of the first and second cap gripper arms upon the facilitation of rotational movement by the at least one upper slot.

20. The filler device sub-assembly of claim 19 wherein:

the at least one upper slot of the outer cam further comprises a longitudinal section and a rotational section; and the at least one lower slot of the outer cam and the at least one slot of the inner cam being obliquely positioned relative to each other.

* * * * *

UNITED STATES PATENT AND TRADEMARK OFFICE

CERTIFICATE OF CORRECTION

PATENT NO. : 6,889,482 B2
DATED : May 10, 2005
INVENTOR(S) : Edwards et al.

It is certified that error appears in the above-identified patent and that said Letters Patent is hereby corrected as shown below:

Column 7,
Line 15, after "varied depending" please insert -- on --.

Column 9,
Line 3, delete "sealing means 16 maybe" and substitute -- sealing means 16 may be --.

Column 12,
Line 58, delete "in detail in FIGS. 111 and" and substitute -- in detail in FIGS. 11 and --.

Column 16,
Line 9, delete "further camprises" and substitute -- further comprises --.
Line 60, delete "outer carn assembly." and substitute -- outer cam assembly. --.
Line 67, after "corresponding" please insert -- to --.

Column 18,
Line 10, delete "outer earn assembly," and substitute -- outer cam assembly, --.
Line 22, delete "The filer device" and substitute -- The filler device --.

Signed and Sealed this

Twenty-fifth Day of October, 2005

JON W. DUDAS
*Director of the United States Patent and Trademark Office*